US007921472B2

(12) United States Patent
Mazzarolo

(10) Patent No.: US 7,921,472 B2
(45) Date of Patent: Apr. 12, 2011

(54) GARMENT ASSOCIATED TO PROTECTIVE INFLATABLE DEVICES

(75) Inventor: Giovanni Mazzarolo, Coste di Maser (IT)

(73) Assignee: Alpinestars Research SRL, Coste di Maser (IT)

( * ) Notice: Subject to any disclaimer, the term of this patent is extended or adjusted under 35 U.S.C. 154(b) by 0 days.

(21) Appl. No.: 10/568,166

(22) PCT Filed: Nov. 20, 2003

(86) PCT No.: PCT/IT03/00754

§ 371 (c)(1), (2), (4) Date: Feb. 9, 2006

(87) PCT Pub. No.: WO2005/048754

PCT Pub. Date: Jun. 2, 2005

(65) Prior Publication Data

US 2006/0218706 A1 Oct. 5, 2006

(51) Int. Cl.
*A41D 1/02* (2006.01)

(52) U.S. Cl. ..... 2/108; 2/DIG. 3

(58) Field of Classification Search ..... 2/108, 69, 2/94, 46, 455, 69.5, 338, DIG. 3, 96
See application file for complete search history.

(56) References Cited

U.S. PATENT DOCUMENTS

| | | | | |
|---|---|---|---|---|
| 4,673,366 | A * | 6/1987 | Hawkins | 441/90 |
| 4,977,623 | A * | 12/1990 | DeMarco | 2/456 |
| 5,127,106 | A * | 7/1992 | Aldridge | 2/81 |
| 5,385,368 | A * | 1/1995 | Bridge | 280/733 |
| 5,500,952 | A * | 3/1996 | Keyes | 2/465 |
| 5,937,443 | A * | 8/1999 | Kageyama et al. | 2/69 |
| 6,125,478 | A * | 10/2000 | Alaloof | 2/456 |
| 6,138,277 | A * | 10/2000 | Gillen et al. | 2/102 |
| 6,230,333 | B1 | 5/2001 | Umeda | |
| 6,298,487 | B1 * | 10/2001 | Mayhew | 2/108 |
| 6,966,070 | B2 * | 11/2005 | Gillen et al. | 2/102 |
| 7,182,662 | B2 * | 2/2007 | O'Meara et al. | 441/111 |

FOREIGN PATENT DOCUMENTS

| | | |
|---|---|---|
| DE | 197 50 898 | 4/1999 |
| FR | 1 555 878 | 1/1969 |
| FR | 2 680 145 | 2/1993 |
| GB | 546082 | 6/1942 |
| GB | 1091005 | 11/1967 |
| GB | 1 524 022 | 9/1978 |
| JP | 11-279813 | 10/1999 |
| JP | 2003-138407 | 5/2003 |
| JP | 2003-147613 | 5/2003 |

OTHER PUBLICATIONS

Japanese Office Action dated Aug. 29, 2009, from the corresponding Japanese Application.

* cited by examiner

*Primary Examiner* — Tejash Patel
(74) *Attorney, Agent, or Firm* — Katten Muchin Posenman LLP

(57) ABSTRACT

Garment (10) comprising means (20, 30) for active protection of the upper part of the body against falls and/or impacts with obstacles, in which a single active protection means (20, 30) extends from one side to the other of the chest above the sternum.

23 Claims, 4 Drawing Sheets

GARMENT ASSOCIATED TO PROTECTIVE INFLATABLE DEVICES

CROSS-REFERENCE TO RELATED APPLICATIONS

This application is the National Stage of International Application No. PCT/IT2003/000754, filed Nov. 20, 2003, now International Publication WO 2005/048754, the content of which is herein incorporated by reference.

The present invention relates to a garment which, in addition to protecting the trunk of a person's body from the normal climate conditions (wind, rain, etc.), is also associated with an inflatable protective device or airbag.

For some years now both research and development and industrial activities are being conducted, albeit on a small scale, with the aim of maximizing the protection, against knocks and violent impacts, of persons performing sporting and non-sporting activities which involve movement at high speed without a cockpit or other protective structure. In particular the category of users at whom this research activity is directed is that of motorcyclists, including both those taking part in high-speed competitions and those performing journeys over more or less long distances on large or medium-size motorcycles.

Articles of clothing equipped or associated with airbags have thus appeared on the market, said airbags being activated automatically when special sensors detect a potentially very dangerous risk in the event of impacts and/or particularly sudden braking.

Among the solutions which constitute the present state of the art, reference may be made to those documented by the patents U.S. Pat. No. 4,977,623 De Marco) and EP-A-1,315,427 (Dainese).

U.S. Pat. No. 4,977,623 discloses a series of articles of clothing accommodating various airbags which are inflated when impact sensors detect a danger condition consisting in a deceleration which is greater than a predetermined threshold. Some sensors are arranged on the vehicle, for example on a motorcycle, and transmit the danger signal via radio waves to the airbag inflation means. Other sensors of the same type are mounted in the same article of clothing and transmit the signal by means of electric leads. In the case of a jacket, inflation of the airbags protects the trunk of the person wearing it This patent does not provide any information as to the manufacture of the articles of clothing, including the manner of arranging the airbags, except for a figure which shows a vertical zip fastener in a position centred on the front of an inflatable jacket.

EP-A-1,315,427 describes an article of clothing consisting of an outer jacket made of textile material and a waistcoat made of flexible composite material and associated by means of a zip fastener with the inner side of the jacket in a position symmetrical with the spinal column of the person wearing said jacket. A first airbag for protecting the back and two further front (right and left) airbags for protecting the two rows of ribs are joined to the waistcoat by means of stitches which are resistant to the pulling force following inflation. These airbags are arranged between the waistcoat and the jacket. The various parts which form the jacket, however, are joined together by stitches which extend along lines different from those of the abovementioned zip fasteners and which break when subjected to a given pulling force. In this embodiment also the airbag inflation means are controlled by an electronic control unit connected to various sensors by means of leads or optical fibres which are at least partially incorporated in the jacket and/or in the waistcoat.

This embodiment has the following drawbacks:

- the article of clothing consists of two separate garments and is inevitably difficult to manufacture owing to the use of different materials and technologies;
- the cost of the waistcoat is high owing to the complexity of the material from which it is made, especially if it also incorporates optical fibres and the like;
- the jacket opens at the front in a central position so that the front airbags are arranged laterally and therefore do not offer any protection to the central chest area (sternum) of the person in event of a frontal impact It would be desirable—and forms the main object of the present invention—to provide those persons performing activities which involve high-speed movements without any surrounding bodywork or similar protective structure with a garment fitted with airbags, which garment has a design which is simpler, more effective and less costly than the articles of clothing known from the present state of the art.

An article having the characteristic features of the accompanying claims is able to achieve this object, together with others, as will become clear from the following description of a preferred, but not exclusive, embodiment consisting of a motorcyclists' jacket This description refers to the accompanying schematic drawings in which:

Figure 1:
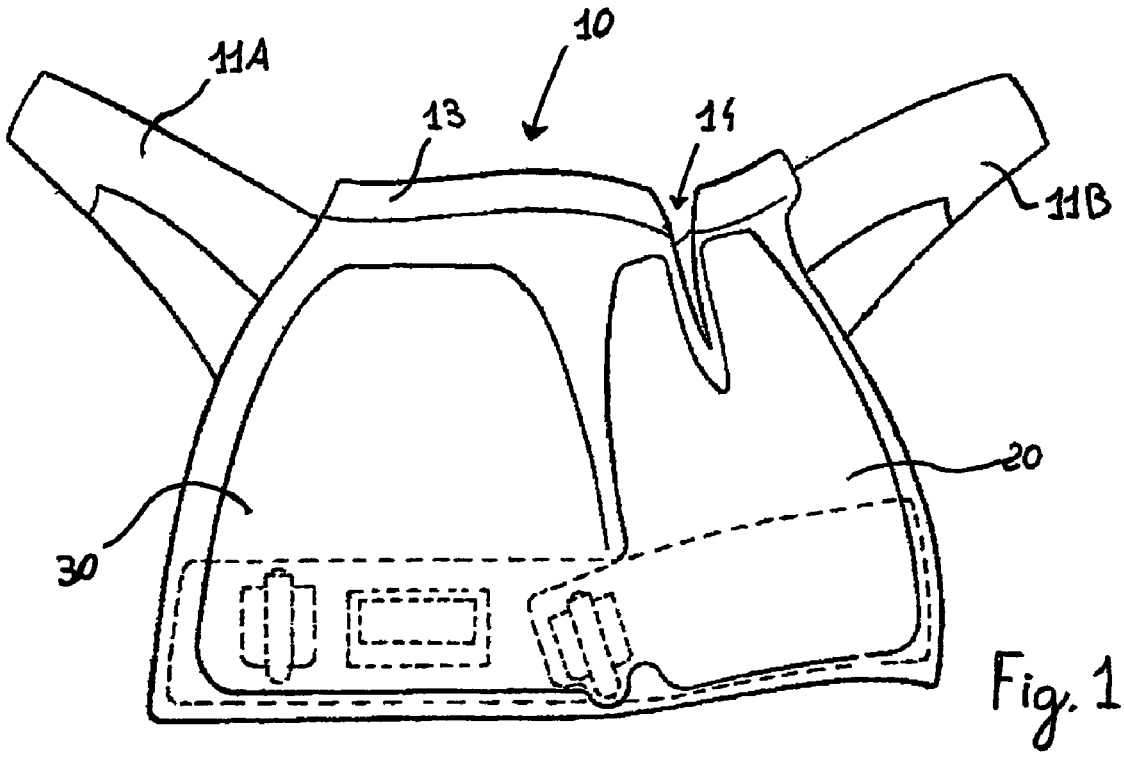
FIG. 1 shows a motorcyclists' jacket according to the invention in the open condition, viewed from the inside.
Figure 2:
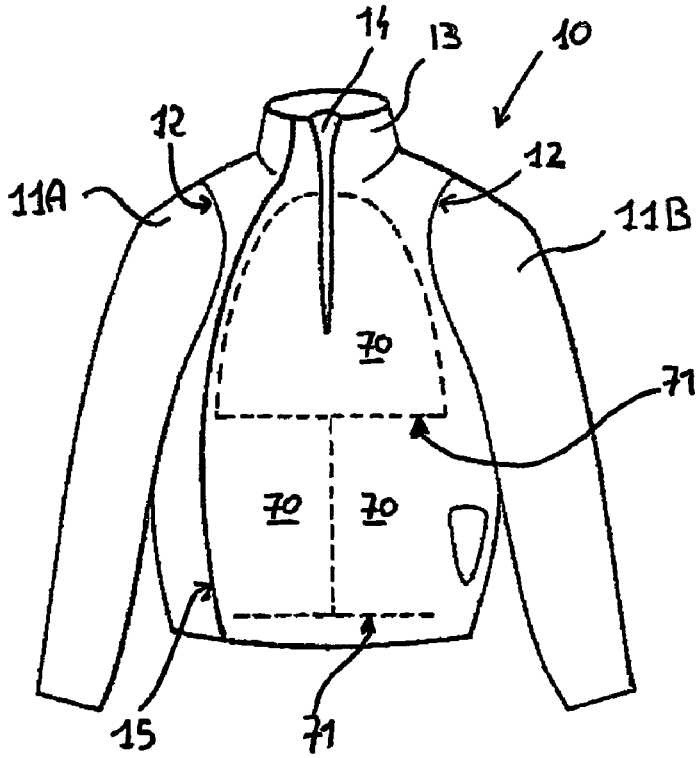
FIG. 2 shows the same jacket in the closed condition, viewed from the front.
Figure 3:
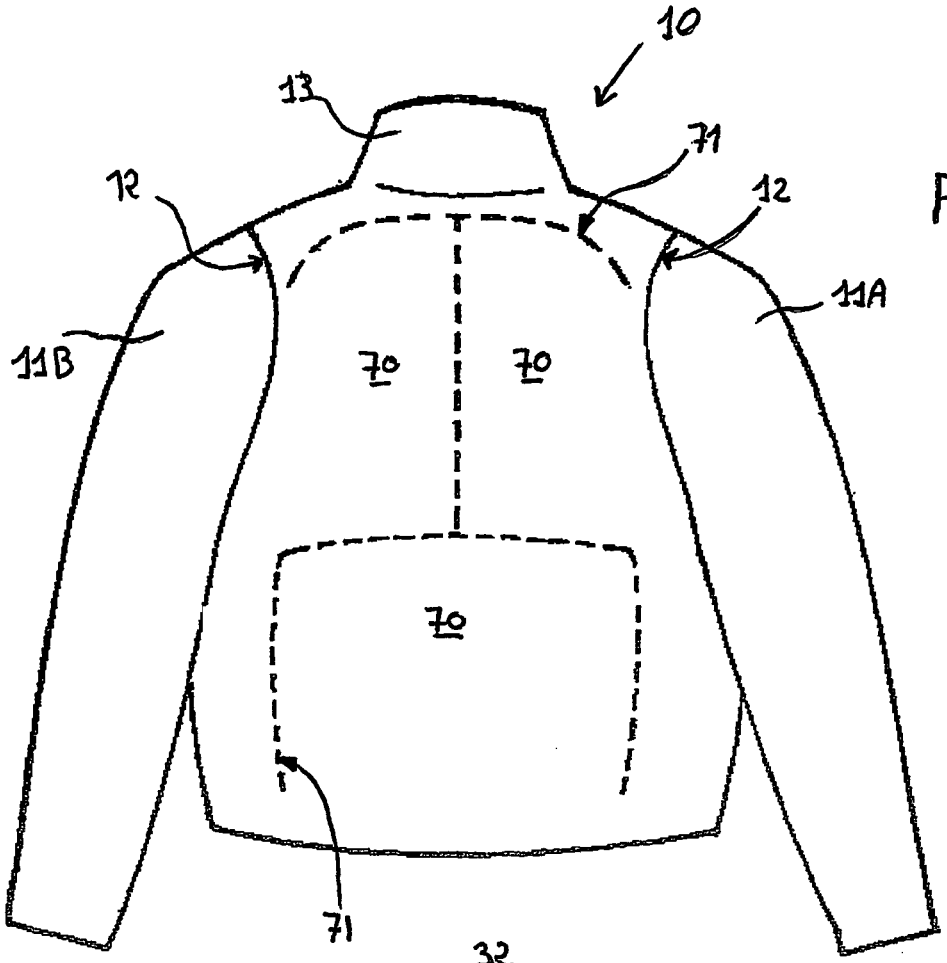
FIG. 3 shows the jacket according to FIGS. 1 and 2, in the closed condition, viewed from the rear.

With reference to FIGS. 1 to 3, a motorcyclists' jacket 10 is conventionally made of synthetic—for example polyamide or polyester-based—materials which are flexible and abrasion-resistant. The jacket 10 comprises, in addition to accessory parts or parts in any case of no relevance for the invention, two sleeves 11A and 11B provided with reinforcements 12, a collar 13 with a short central lowered neckline 14 which can be preferably closed by means of a zip fastener (not shown).

According to a characteristic feature of the invention, the front opening 15, which moreover extends conventionally over the entire height of the jacket, is not straight and in a central position, namely along the central chest area of the person wearing the jacket, but is in a position offset along a line curved inwards towards the sleeve 11A—see FIG. 2. The front opening 15 is also preferably able to be closed by means of a zip fastener (not shown).

According to another characteristic feature of the invention, a first airbag 20 and a second airbag 30 are fixed to the inner side of the jacket 10. This fixing operation is performed, in the embodiment described and illustrated here, by means of respective stitches 25 and 35 which extend along the perimeter of the airbags 20 and 30.

Figure 5:
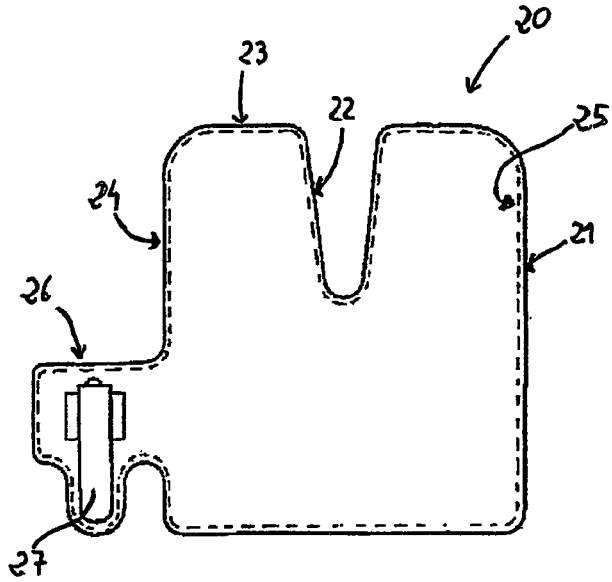
FIG. 5 shows the front airbag associated with the jacket according to FIGS. 1 to 3, viewed from the rear.

As can be seen in FIG. 5, the first airbag 20 has a perimeter which is substantially rectangular with a vertical side 21 aligned with one edge of the front opening 15 of the jacket 10, but with a V-shaped cut-out 22 along the upper side 23, at the lowered neckline 14 of the jacket 10, and an appended portion 26, which also has a substantially rectangular perimeter, extending from the other vertical side 24. The appended portion 26 accommodates a known pyrotechnic device 27 (for example such as that produced by Autoliv or TRW) for inflating the airbag 20 when a serious risk condition is detected, as will be explained more dearly below. The horizontal amplitude of this airbag 20 is such that its second side 24 extends vertically from the joining point of the left-hand sleeve 11B. This means that the whole front area of the trunk of the person wearing the jacket 10 is protected by the first airbag 20, namely the sternum also, unlike in the case of the second type of airbag mentioned in the above description of the prior art in connection with the present invention.

Figure 4:
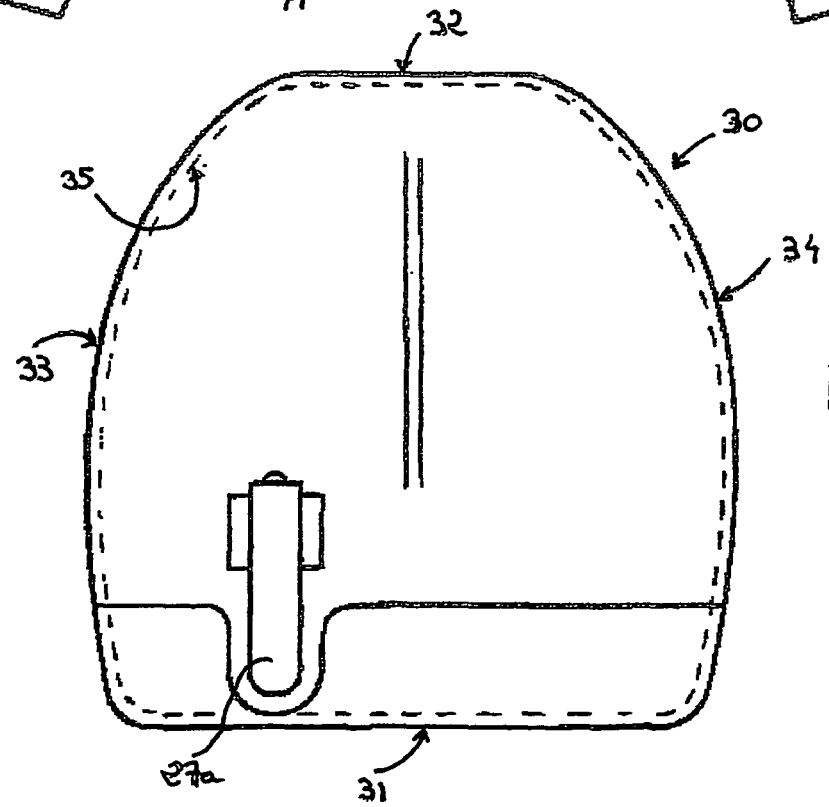
FIG. 4 shows the rear airbag associated with the jacket according to FIGS. 1 to 3, viewed from the rear.

In turn, as can be seen in FIG. 4, the second airbag 30 has substantially the perimeter of an isosceles trapezium. The bottom end 31 of the second airbag 30, which extends from the immediate vicinity of the second vertical side 24 of the first airbag 20 to the other edge of the front opening 15, is bigger than the upper end 32, which extends along the collar 13 of the jacket 10; the sides 33 and 34 of the second airbag 30 are curved outwardly, in the same manner as the front opening 15. In the vicinity of the bottom end 31 there is situated a second pyrotechnic device 27*a*, which is constructionally and functionally identical to the device 27 already mentioned, for performing inflation of the airbag 30. While the first airbag 20 protects the user's chest and abdomen, the second airbag protects the user's back, being fixed (see FIG. 1) to the rear of the jacket 10.

Figure 6:
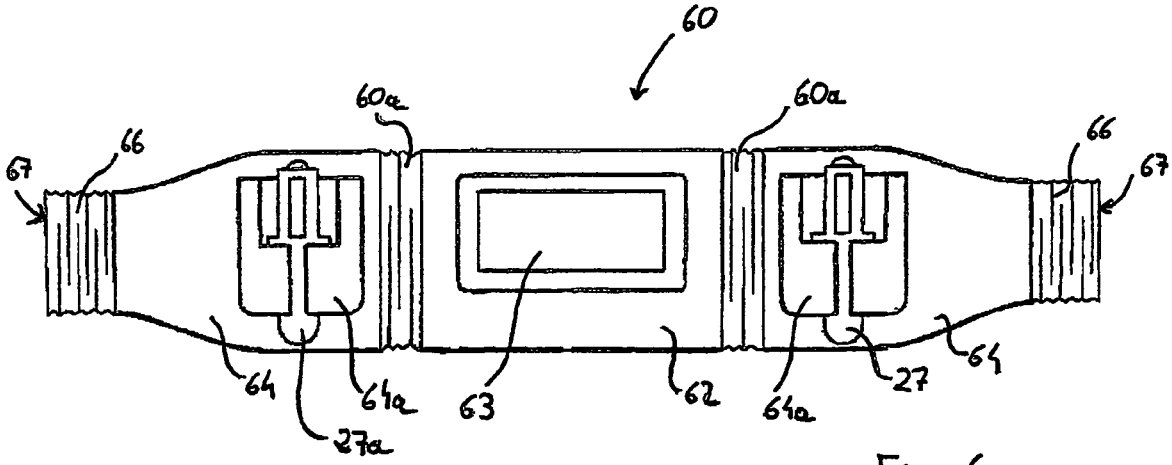
FIG. 6 shows a belt which is associated with the jacket according to FIGS. 1 to 3, viewed in the open condition and from the outside.

FIG. 6 shows a belt 60, which is made for example of plastic material associated with the jacket 10. Said belt, in the embodiment described here, comprises a rectangular central element 62 connected, by means of two flexible strips 60*a*, to two lateral elements 64. The lateral elements 64, on the opposite side to the element 62, are tapered, terminating in an appendage 66 made of flexible material and comprising means 67 for closing the belt 60. These closing means may be made, for example, using two Velcro® strips. The central element 62 houses an electronic module 63 which receives and processes the risk and/or danger signals emitted by suitable sensors (not shown) situated on the jacket and/or on the vehicle and, if necessary, activates the pyrotechnic devices 27, 27*a* for inflation of the airbags 20 and 30. The activation of the pyrotechnic devices 27, 27*a* by the electronic module requires the provision of suitable connecting cables (not shown). Said cables may consist, for example, of copper conductors, flat leads or the like and/or optical fibres. The lateral elements 64 comprise seats 64*a* suitably shaped for supporting the pyrotechnic devices 27, 27*a*.

Figure 7:
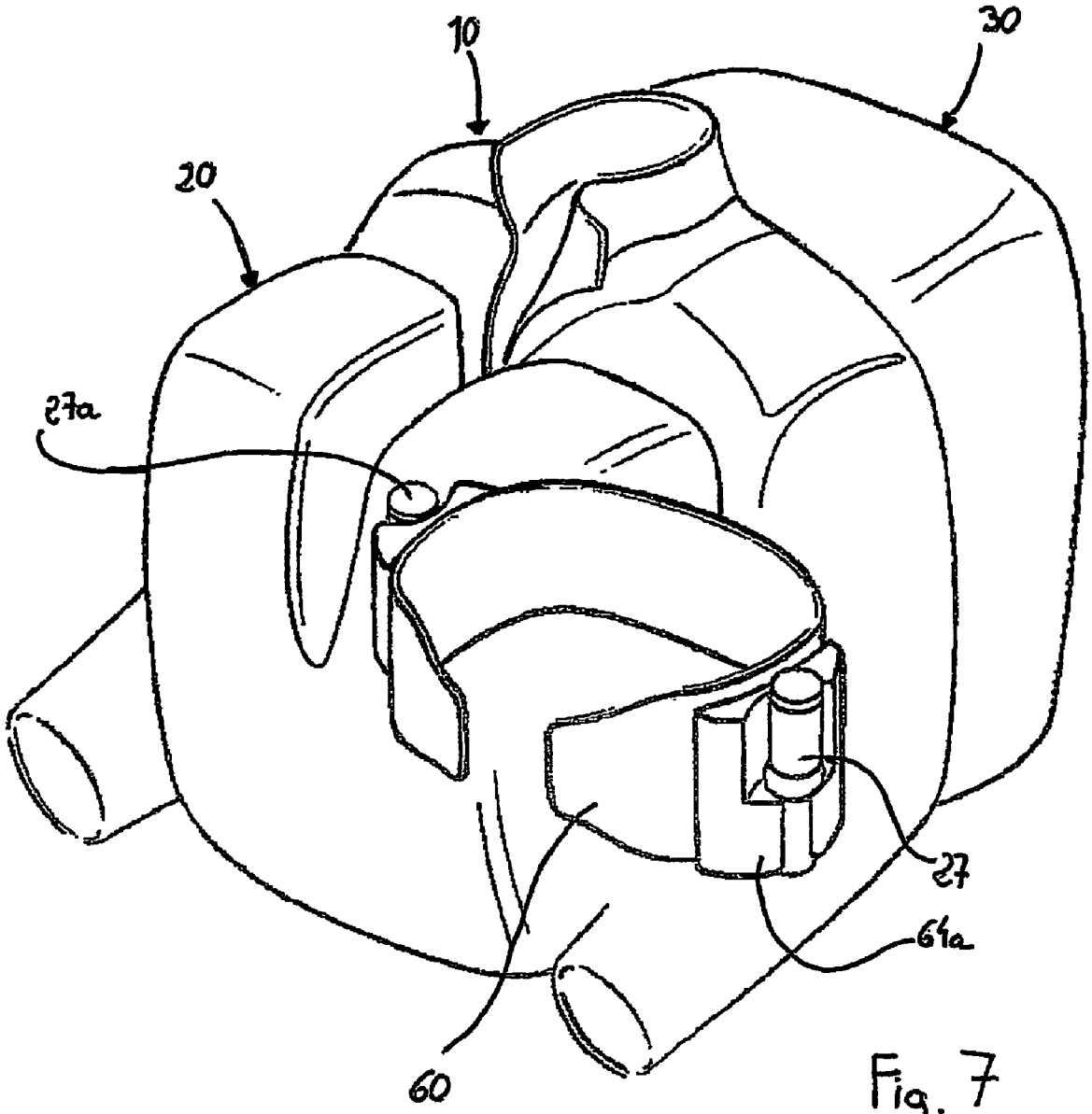
FIG. 7 shows a three quarters view, from the front and in a partially transparent manner, of the overall appearance of the jacket when both the airbags according to FIGS. 4 and 5 are inflated.

The belt 60, see FIGS. 1 and 7, is fixed over a part of its length along the inside of the jacket 10, for example, by means of stitching, so that it is positioned, when the jacket is closed, around the user's waist Once the airbags 20 and 30 have been fitted to the jacket 10 during the manufacturing stage, the associated pyrotechnic devices 27, 27*a* are inserted into the seats 64*a* so that they are stably fixed there. In order to put on the jacket 10 correctly, the user must first fasten the belt 60 around his/her waist using the closing means 67 and then close the jacket 10 using—in this embodiment—the associated zip fastener.

The jacket 10 (see FIGS. 2 and 3) comprises, at the front and rear, flaps 70 covering the airbags 20 and 30. Said flaps, the edges 71 of which are shown in broken lines in FIGS. 2 and 3, are releasably joined to the jacket 10, for example by means of Velcro® strips or stitches with a predefined breakage strength, arranged along the edges 71 of said flaps. In order for the airbags 20 and 30 to be effective, it is necessary for them to inflate instantly and to the maximum of their volume, thereby ensuring maximum protection. Since expansion of the airbags could be opposed by the resistance of the material from which the jacket 10 is made, resulting also in the risk of a sudden impact for the user, this expansion is allowed to take place towards the outside of the jacket 10. Upon activation of the pyrotechnic devices 27, 27*a* and consequent inflation of the airbags 20 and 30, the flaps 70 separate from the rest of the jacket 10, allowing the said airbags to move outwards and expand since the joining means give way along the edges 71 of the flaps 70. The form and arrangement of the flaps 70 may obviously be different from those shown in the accompanying figures, it being essential only that the jacket 10 is able to give way in certain zones under the thrust of the expanding airbags.

This embodiment of the jacket 10 is dearly subject to numerous variants. For example the front opening 15 may be provided on the left-hand side or the jacket 10 may be sleeveless. As regards the airbags 20 and 30, both of them may have forms different from those shown and may be combined with the pyrotechnic devices 27, 27*a* in different positions. Moreover, the belt 60 may be designed, while retaining the characteristic features described, in such a way as to surround the rider's chest. Similarly it is possible to provide a structure similar to the belt 60, but supported by straps passing over the shoulders and/or around the rider's neck.

The characteristic features of the invention may dearly be applied to a garment which instead also covers the bottom part of the body, for example a suit.

The embodiment described, the variants mentioned hereinabove and all the embodiments implying the inventive idea of the present invention are to be regarded as included within the scope of protection of the following claims.

The invention claimed is:

1. A garment suitable for one of athletes and motorcyclists, the garment comprising:

a jacket comprising a plurality of airbags to ensure an active protection of the upper part of a body of one of athletes and motorcyclists against one of trauma and fracture due to one of falls and impact against an obstacle, said airbags being associated to an inflating device activated by electronic means in response to the detection of one of risk and danger signals emitted by sensors;

wherein the jacket further comprises a front opening for access into and out of the garment by the one of athletes and motorcyclists, the front opening being in a position offset from a longitudinal centerline of the jacket toward a sleeve, the front opening comprising a curved line through a length of the jacket starting at a hemline and ending at a collar, the curved line being directed toward the sleeve;

wherein a first of said airbags extends from one side to the other of a chest above the sternum; and wherein said inflating device is also comprised in the jacket.

2. The garment of claim 1, wherein the inflating device comprises pyrotechnics.

3. The garment of claim 1, wherein said sensors are incorporated in the jacket.

4. The garment of claim 1, wherein a second airbag of the plurality of airbags is arranged on a back portion of the jacket.

5. The garment of claim 4, wherein said first and second airbag are covered by flaps, the flaps being releasably joined to a remaining portion of the garment.

6. The garment of claim 1 further comprising a support means for housing the inflating device, said support means being joined to an inside of the jacket.

7. The garment of claim 6, wherein the support means comprises a belt.

8. The garment of claim 6, wherein the support means comprises a band for winding around the chest.

9. The garment of claim 6, wherein the support means comprises a strap.

10. The garment of claim 6, wherein the support means also houses said electronic means.

11. The garment of claim 1 further comprising a bottom portion for covering a bottom part of a body.

12. The garment of claim 1, wherein the front opening comprises a closure.

13. The garment of claim 12, wherein the closure comprises a zippered closure.

14. A garment suitable for one of athletes and motorcyclists, the garment comprising:

a jacket comprising a first airbag to ensure an active protection of the upper part of a body of one of athletes and motorcyclists against one of trauma and fracture due to one of falls and impact against an obstacle, the first airbag extending from a one side to another side of the chest above the sternum;

an inflating device associated with the first airbag, the inflating device activated by electronic means in response to the detection of one of risk and danger signals emitted by a sensor, a front opening in a position offset from a longitudinal centerline of the garment toward a sleeve, the front opening being for access into and out of the garment by the one of athletes and motorcyclists, the front opening comprising a curved line through a length of the jacket starting at a hemline and ending at a collar, the curved line being directed toward the sleeve;

a zip fastener disposed in the front opening for opening and closing the opening;

an inflating device comprised in the jacket;

wherein the sensor is incorporated in the jacket.

15. The garment of claim 14, wherein the inflating device comprises pyrotechnics.

16. The garment of claim 14, wherein a second airbag is arranged on a back portion of the jacket, the second airbag associated with the inflating device.

17. The garment of claim 16, wherein said first and second airbag are covered by flaps, the flaps being releasably joined to a remaining portion of the garment.

18. The garment of claim 14 further comprising a support means for housing the inflating device, said support means being joined to an inside of the jacket.

19. The garment of claim 18, wherein the support means comprises a belt.

20. The garment of claim 18, wherein the support means comprises a band for winding around the chest.

21. The garment of claim 18, wherein the support means comprises a strap.

22. The garment of claim 18, wherein the support means also houses said electronic means.

23. A garment suitable for one of athletes and motorcyclists, the garment comprising:

a jacket comprising a plurality of airbags to ensure an active protection of the upper part of a body of one of athletes and motorcyclists against one of trauma and fracture due to one of falls and impact against an obstacle, said airbags being associated to an inflating device activated by electronic means in response to the detection of one of risk and danger signals emitted by sensors;

wherein the jacket further comprises a front opening in a position offset from a longitudinal centerline of the jacket toward a sleeve, the front opening comprising a curved line directed toward the sleeve;

wherein a first of said airbags extends from one side to the other of a chest above the sternum, the plurality of airbags being covered by flaps, the flaps being releasably joined to a remaining portion of the garment; and wherein said inflating device is also comprised in the jacket.

* * * * *